US008522592B2

(12) United States Patent
Sakae

(10) Patent No.: US 8,522,592 B2
(45) Date of Patent: Sep. 3, 2013

(54) FORMING APPARATUS FOR FORMING EXTRUDED HOLLOW SECTION

(75) Inventor: Akira Sakae, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/446,403

(22) Filed: Apr. 13, 2012

(65) Prior Publication Data

US 2012/0198903 A1 Aug. 9, 2012

Related U.S. Application Data

(62) Division of application No. 12/096,261, filed as application No. PCT/JP2006/323230 on Nov. 21, 2006, now Pat. No. 8,202,625.

(30) Foreign Application Priority Data

Dec. 6, 2005 (JP) ..... 2005-352493

(51) Int. Cl.
*B21C 25/08* (2006.01)
*B21C 23/08* (2006.01)

(52) U.S. Cl.
USPC ..... 72/260; 72/263; 72/272

(58) Field of Classification Search
USPC ..... 72/260, 263, 264, 267–269, 276, 72/283–285, 370.01, 370.14, 370.15, 370.23, 72/370.26, 272; 29/897.2, 33 D, 33 T
See application file for complete search history.

(56) References Cited

U.S. PATENT DOCUMENTS

| | | | | |
|---|---|---|---|---|
| 2,228,301 | A | 1/1941 | Ditzel et al. | |
| 2,899,053 | A * | 8/1959 | Govan | 72/256 |
| 3,259,975 | A | 7/1966 | Chapman | |
| 3,540,094 | A * | 11/1970 | Janssen | 425/3 |
| 4,095,447 | A | 6/1978 | Shevchenko et al. | |
| 4,527,978 | A | 7/1985 | Zackrisson | |
| 5,346,432 | A | 9/1994 | Greulich et al. | |
| 5,540,016 | A | 7/1996 | Clausen | |
| 5,643,093 | A | 7/1997 | Breese | |
| 6,248,189 | B1 | 6/2001 | Shaffer et al. | |
| 2012/0192613 | A1 | 8/2012 | Sakae | |

FOREIGN PATENT DOCUMENTS

| | | |
|---|---|---|
| JP | 07-23617 | 5/1995 |
| JP | 2002-35825 | 2/2002 |
| JP | 2003-326311 | 11/2003 |

* cited by examiner

*Primary Examiner* — Debra Sullivan
(74) *Attorney, Agent, or Firm* — Oblon, Spivak, McClelland, Maier & Neustadt, L.L.P.

(57) ABSTRACT

A forming apparatus for an extruded hollow section has a fixed die provided with a forming hole having guide grooves extending in a direction tilting against a direction of extrusion, and movable dies disposed to be able to travel along the guide grooves, respectively. The fixed die has a base part bridging between inner faces of the forming hole, and a hole forming part extended from an end of the base part, on a downstream side thereof, toward downstream inside the forming hole. The movable dies are disposed inside the forming hole with a gap remaining between the hole forming part and each of the movable dies.

4 Claims, 6 Drawing Sheets

FORMING APPARATUS FOR FORMING EXTRUDED HOLLOW SECTION

The present application is a divisional application of U.S. Ser. No. 12/096,261, filed on Jun. 5, 2008, the entire contents of which is incorporated herein by reference. U.S. Ser. No. 12/096,261 is the National Stage of PCT/JP06/323230 filed Nov. 21, 2006, which is based upon and claims benefit of priority from Japanese application No. 2005-352493, filed Dec. 6, 2005.

TECHNICAL FIELD

The invention relates to an extruded hollow section, a forming apparatus for forming the same, and a method for forming the same.

BACKGROUND ART

To fabricate a hollow member having regions differing in wall thickness from each other, it has been a past practice to combine another member separate from the hollow member with the hollow member as shown in, for example, Patent Document 1. As shown in FIG. 13, in the case of a hollow member 80 disclosed in this Patent Document, a reinforcement member 82 is fitted onto a hollow base body 81 in one piece, cut out of an aluminum extruded section, thereby making up a central part of the hollow member 80 so as to be lager in wall thickness. Further, the hollow member 80 is for use as a guard bar for a vehicle.

Patent Document 1: JP-UM-A 07 (1995)-023617

For fabrication of the hollow member 80 having parts varying in wall thickness, a separate member is fitted thereto as disclosed in the past, so that an increase in the number of man-hours for production is unavoidable. In addition, in the case of this hollow member 80, variation is prone to occur to location of the reinforcement member 82 when the reinforcement member 82 is fitted, so that there are limitations to stability in quality of the hollow member 80.

Further, since the conventional hollow member 80 is made up such that separate members are fitted thereto, it is difficult to fabricate one gradually varying in thickness. Assuming the case of fabricating a hollow member gradually varying in thickness, a secondary work such as cutting, and so forth will be required after the separate members are combined with the hollow member. Accordingly, it inevitably becomes complex to fabricate a hollow member of such a makeup as described.

DISCLOSURE OF THE INVENTION

It is therefore an object of the invention to eliminate problems described as above. Further another object of the invention is to provide an extruded hollow section that can be fabricated in fewer production man-hours, and is furthermore stable in quality.

To that end, according to one aspect of the present invention, an extruded hollow section formed in a hollow shape by extrusion includes parallel parts each having a width in one direction within a section vertical to a direction of extrusion, being constant along the direction of the extrusion, and tilt parts each having a width in the one direction, varying along the direction of the extrusion, and the parallel parts are integrally formed with the tilt parts.

BEST MODE FOR CARRYING OUT THE INVENTION

Preferred embodiments of the invention are described in detail hereinafter with reference to the accompanying drawings.

Figure 1:
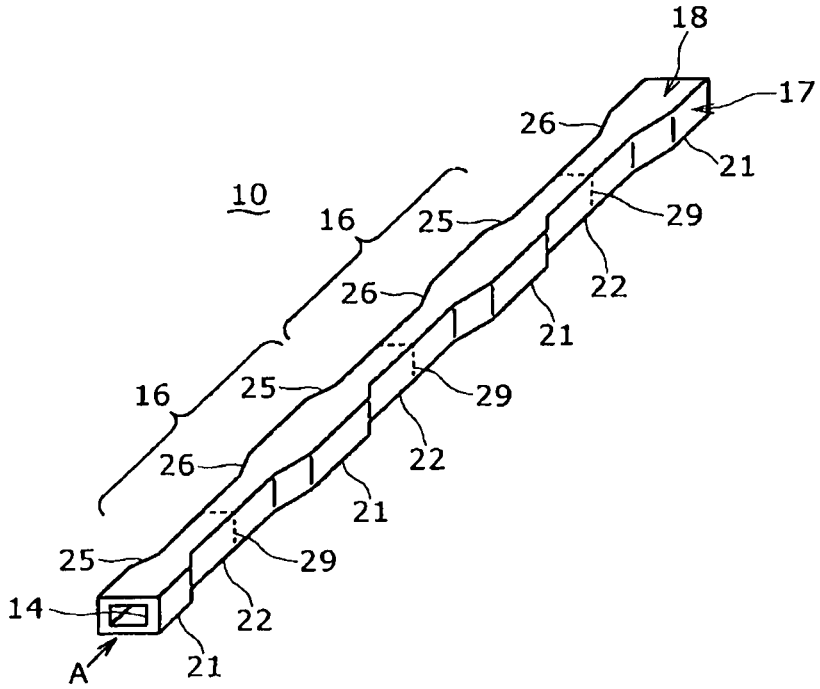
FIG. 1 is a perspective view showing one embodiment of a hollow section according to the invention.

FIG. 1 shows one embodiment of an extruded hollow section according to the invention. The extruded hollow section (hereinafter referred to merely as a hollow section) 10 according to the present embodiment is formed by extrusion forming, and a direction in which the arrow A is oriented in FIG. 1 indicates a direction of extrusion.

Figure 2:
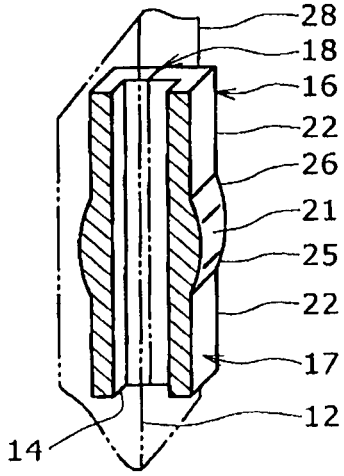
FIG. 2 is a longitudinal sectional view of a partial section cut out of the hollow section.

The hollow section 10 is formed in the shape of a square cylinder rectangular and ring-like in cross-section vertical to a cylinder axis 12 (refer to FIG. 2) extending in the direction of the extrusion. And the hollow section 10 has a bore 14 formed so as to be rectangular in shape, the bore 14 being constant in height and width, respectively, along the direction of the extrusion throughout the hollow section 10.

The hollow section 10 is provided with parallel parts 21, 22, and tilt parts 25, 26. As to any of those tilt parts 25, 26, and those parallel parts 21, 22, a plurality of units are provided, and the respective tilt parts and the respective parallel parts are alternately formed so as to be lined up along the direction of the extrusion. The parallel parts 21, 22 each are a part where a region having a height as well as a width remaining constant along the direction of the extrusion, that is, side faces 17 thereof, opposing each other, in the crosswise direction, are parallel with each other, and side faces 18 thereof, opposing each other, in the direction of height, are parallel with each other. Herein, the width refers to a width from side to side in FIGS. 1, and 2. Further, the height in this case refers to a width in the vertical direction in FIG. 1, that is, a width in the direction of depth in FIG. 2.

The parallel part includes a first parallel part 21, and a second parallel part 22 differing in width from the first parallel part 21. The second parallel part 22 differs in width from the first parallel part 21, but is identical in height to the first parallel part 21. The first parallel part 21, and the second parallel part 22 are alternately formed in the direction of the extrusion. With the present embodiment, the first parallel part 21 is larger in the width than the second parallel part 22.

The tilt part includes a first tilt part 25, and a second tilt part 26. A tilt orientation of the side face 17 of the first tilt part 25 is opposite to that of the side face 17 of the second tilt part 26. More specifically, with the first tilt part 25, the side faces 17 each tilt such that the width of the first tilt part 25 decreases along the direction of the extrusion. In other words, with the first tilt part 25, the side faces 17 tilt such that the side faces 17, 17, on respective sides of the first tilt part 25, come closer to each other along the direction of the extrusion. In contrast, with the second tilt part 26, the side faces 17 each tilt such that the width of the second tilt part 26 increases along the direction of the extrusion. In other words, with the second tilt part 26, the side faces 17 each tilt such that the side faces 17, 17, on respective sides of the second tilt part 26 part further away from each other along the direction of the extrusion. That is, the first tilt part 25 is the region subjected to extrusion forming such that the width thereof gradually decreases from that of the first parallel part 21 toward that of the second parallel part 22 while the second tilt part 26 is the region subjected to extrusion forming such that the width thereof gradually increases from that of the second parallel part 22 toward that of the first parallel part 21.

The tilt parts 25, 26 each are formed in a shape symmetrical with respect to a plane 28 containing a cylinder axis 12. The plane 28 is a plane parallel to the side face 17, on both sides of the parallel parts 21, 22, respectively, in the crosswise direction. Then, the tilt parts 25, 26 each have the side faces 17 tilting such that the respective widths of the tilt parts 25, 26, in a direction vertical to the plane 28, vary on respective sides of the plane 28, along the direction of the extrusion, and the respective widths of the tilt parts 25, 26, on respective sides of the hollow section 10, with the plane 28 being interposed therebetween, vary along the direction of the extrusion. Further, the tilt parts 25, 26, on the respective sides of the plane 28, are identical also in ratio of change in width to each other.

The first tilt part 25, and the second tilt part 26 are identical in height to each other, and are identical in height to the respective parallel parts 21, 22 as well. While a pair of the side faces 18, opposing each other, in the height direction, among external faces of the hollow section 10, excluding end faces thereof, are each formed planar in shape, another pair of side faces (the side faces 17, 17, opposing each other, in the crosswise direction) are formed in a depressed shape and a protruded shape, respectively.

The hollow section 10 is made of a light metal. More specifically, as a stock of the hollow section 10, use is made of an aluminum alloy of JIS 6000 series, or JIS 7000 series.

The hollow section 10 can be divided into a plurality of pieces by cutting. Such a division line is indicated by a phantom line 29 in FIG. 1. With respective partial sections 16 obtained by division, the second parallel part 22 is disposed at both ends of the partial section 16, and the first parallel part 21 is disposed at the central part of the partial section 16. In consequence, the partial section 16 has the both ends smaller in width, and the central part larger in width. The partial section 16 can be used as, for example, a door beam disposed at the door of a vehicle, to serve as a reinforcing member.

Figure 3:
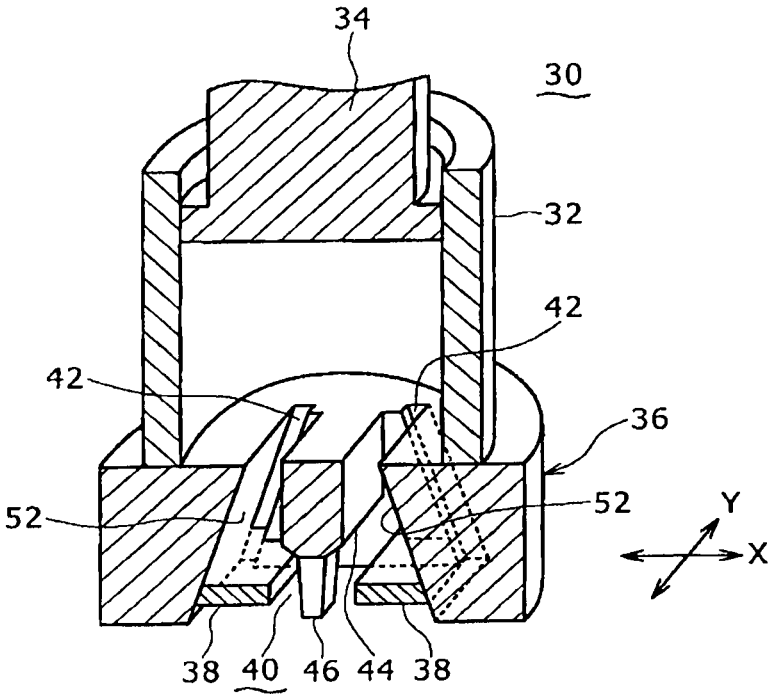
FIG. 3 is a partially exploded perspective view broadly showing principal parts of a forming apparatus for forming the hollow section.

Next, referring to FIG. 3, there is described hereinafter a forming apparatus 30 for forming the hollow section 10. FIG. 3 broadly shows principal parts of the forming apparatus 30.

The forming apparatus 30 includes a container 32, a stem 34, a fixed die 36, and a pair of movable dies 38, 38. A billet (not shown) is charged into the container 32 and the billet in the container 32 is extruded by the stem 34.

The fixed die 36 is secured to an end part of the container 32, on an extrusion side thereof, and the fixed die 36 is provided with a forming hole 40 penetrating therethrough in the direction of the extrusion. In the forming hole 40, a section vertical to the direction of the extrusion is formed rectangular in shape, and a width in one direction (Y-direction in FIG. 3) within the section is constant along the direction of the extrusion. That is, a pair of inner faces opposing each other in the Y-direction are planes parallel with each other. Meanwhile, with the forming hole 40, a width in a direction (X-direction in FIG. 3) orthogonal to the Y-direction, within the section, gradually increases along the direction of the extrusion, and a pair of inner faces opposing each other in the X-direction are each formed as a tilt plane.

The forming hole 40 is provided with guide grooves 42, 42, for guiding the movable dies 38, 38, respectively. The guide grooves 42, 42 are provided at an end part of the forming hole 40, in the Y-direction, and the guide grooves 42, 42 are formed in two units in such a way as to correspond to the respective movable dies 38, 38. Further, both the guide grooves 42, 42 are disposed so as to tilt against the direction of the extrusion such that an interval therebetween spreads along the direction of the extrusion. Both the guide grooves 42, 42 each have an identical tilt angle in relation to the direction of the extrusion.

The fixed die 36 has a base part 44 provided on the inner side of the forming hole 40, and a hole forming part 46 extended from an end of the base part 44, on a downstream side thereof, toward downstream inside the forming hole 40. More specifically, the base part 44 is provided in an upstream side part (an upper side part in FIG. 4) of the forming hole 40, and the base part 44 is integrally formed with the fixed die 36 in such a way as to bridge between the pair of the inner faces opposing each other in the Y-direction. A portion of the forming hole 40, on the inlet side thereof, is divided in two holes by the base part 44.

The hole forming part 46 is disposed in a downstream side part of the forming hole 40. The hole forming part 46 is formed rectangular in section vertical to the direction of the extrusion, and in the shape of protrusion slightly decreasing in width toward the direction of the extrusion. Further, there exists space around the hole forming part 46. As a result, the forming hole 40 partitioned into two holes on the inlet side thereof has one hole in a part thereof, on the outlet side, where the base part 44 does not exist.

Figure 4:
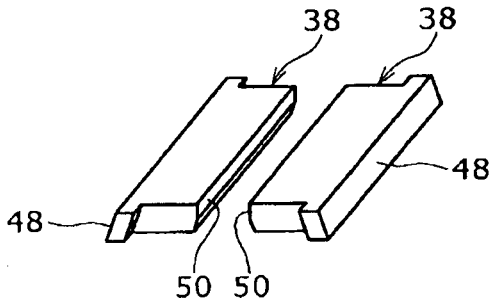
FIG. 4 is a perspective view of movable dies provided in the forming apparatus.

As shown in FIG. 4, the movable dies 38, 38, in two units, are provided and are formed so as to be symmetrical to each other in shape. The respective movable dies 38, 38 are formed in the shape of a flat plate having a slidably contact face 48, and a forming face 50. Then, the respective movable dies 38, 38, in a posture orthogonal to the direction of the extrusion, are disposed in the forming hole 40 of the fixed die 36 to be fitted into the respective guide grooves 42, 42. Further, the respective movable dies 38, 38 are disposed at positions opposite to each other in the x-direction within a range of a length of the hole forming part 46. An interval between the respective movable dies 38, 38 is rendered rectangular and ring-like in shape owing to presence of the hole forming part 46. The slidably contact face 48 of the movable die 38 in this state is slidable on a guide face 52 of the forming hole 40. Further, if the movable die 38 is caused to travel along guide groove 42, this will enable the movable die 38 to travel in a direction tilting against the direction of the extrusion.

The slidably contact face 48 tilts against the forming face 50 at an angle identical to a tilt angle formed by the guide face 52 with the direction of the extrusion. The respective forming faces 50, 50 of the movable dies 38, 38 are disposed so as to be parallel with the direction of the extrusion, and to oppose each other, and the billet is caused to pass between the respective forming faces 50, 50, whereupon the hollow section 10 is extruded.

The movable dies 38, 38 are driven in the direction of the extrusion within the range of the length of the hole forming part 46 by a drive mechanism (not shown in the figure). The drive mechanism is made up such that the movable dies 38, 38 are caused to concurrently travel while a state of the movable dies 38, 38, opposing each other in the direction orthogonal to the direction of the extrusion, is maintained. By so doing, the hollow section 10 can be extruded in a straight line.

In order to form the hollow section 10 by use of the forming apparatus 30, a billet made of an aluminum alloy is first charged in the container 32, and the billet is extruded into the forming hole 40 by the stem 34. At this point in time, the billet is fed from an upper side in FIG. 3 into the forming hole 40 to be thereby extruded downward.

Figure 5:
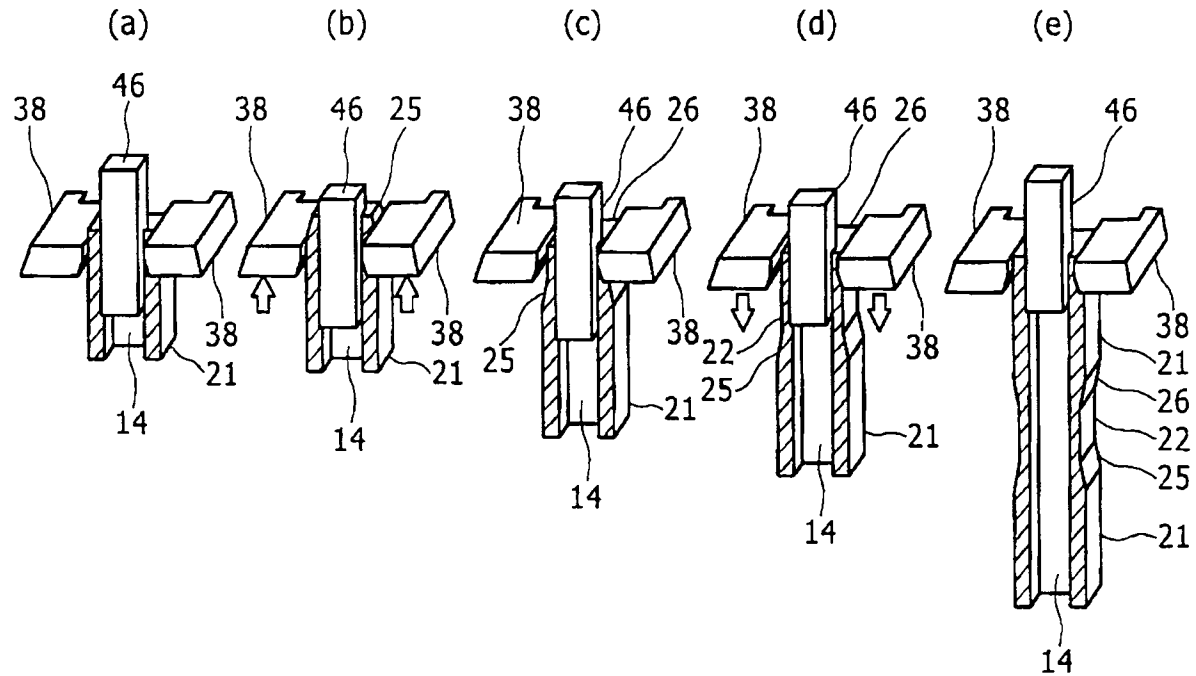
FIG. 5 is a schematic illustration showing operations for extrusion forming of the hollow section, executed by the forming apparatus, in which (a) shows a state of extrusion of a first parallel part, (b) a state of subsequent extrusion of a first tilt part, (c) a state of subsequent extrusion of a second parallel part, (d) a state of subsequent extrusion of a second tilt part, and (e) a state of subsequent extrusion of another first tilt part.

If the movable dies 38, 38 are positioned on the downstream side of the guide grooves 42, 42, respectively, and are fixed in a state in which the movable dies are far off from each other, as shown in FIG. 5(*a*), the first parallel part 21 larger in width is extruded from the forming hole 40. Then, when the movable dies 38, 38 are caused to travel toward upstream by the drive mechanism, as shown in FIG. 5(*b*), the interval between the movable dies 38, 38 gradually decreases, so that the hollow section 10 extruded following such traveling gradually decreases in width. Thus, the first tilt part 25 is formed. At this point in time, the bore 14 of the hollow section 10 is formed by the hole forming part 46, so that the bore 14 is maintained constant in sectional shape. Meanwhile, since the width of the hollow section 10 gradually decreases, the first tilt part 25 is formed such that the wall thickness thereof gradually decreases.

Thereafter, when the movable dies 38, 38 are fixed at respective upstream side parts of the guide grooves 42, 42, as shown in FIG. 5(*c*), the hollow section 10 is extruded with the width thereof, kept constant. It follows that the second parallel part 22 smaller in width is extruded. Then, when the movable dies 38, 38 are caused to travel toward downstream this time, as shown in FIG. 5(*d*), the interval between the movable dies 38, 38 gradually increases. Accordingly, the hollow section 10 extruded following such traveling gradually increases in width. Thus, the second tilt part 26 is formed. Thereafter, when the movable dies 38, 38 are fixed at the respective downstream side parts of the guide grooves 42, 42, the first parallel part 21 is extruded again, as shown in FIG. 5(*d*). By repeating such operations, it is possible to implement extrusion forming of the hollow section 10 shown in FIG. 1.

Figure 6:
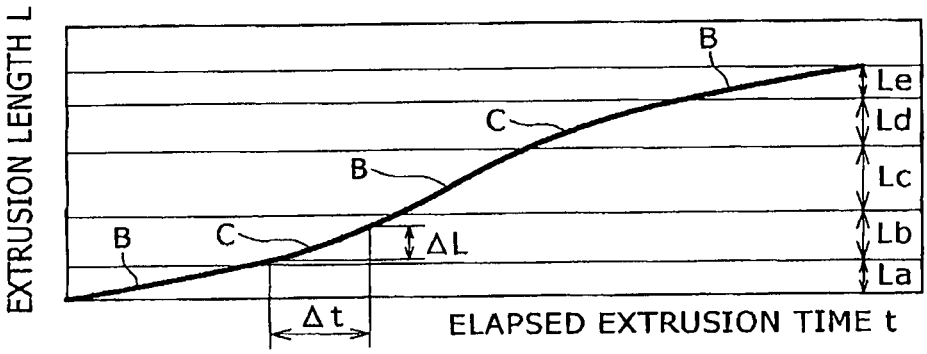
FIG. 6 is a characteristic plot showing a relationship between elapsed extrusion time and an extrusion length when the hollow section is extruded.

At the time of extrusion forming, the stem 34 is caused to travel at a speed maintained constant. Accordingly, when the interval between the movable dies 38, 38 remains constant as is the case with when the parallel parts 21, 22 are extruded, an extrusion rate of the hollow section 10 becomes constant as indicated by reference numeral B in FIG. 6. It is therefore possible to work out an extrusion length of the hollow section 10 from extrusion time. Accordingly, timing for starting the traveling of the movable dies 38, 38 can be controlled on the basis of the extrusion time. In FIG. 6 showing such a case, there are shown a length of the first parallel part 21 as La, Le, and a length of the second parallel part 22 as Lc.

Meanwhile, when the movable dies 38, 38 are caused to gradually travel as is the case with when the respective tilt parts 25, 26 are extruded, it follows that respective extrusion amounts vary according to respective traveling amounts of the movable dies 38, 38 (refer to reference numeral C in FIG. 6). In this case, since respective extrusion lengths are worked out on the basis of the respective traveling amounts of the movable dies 38, 38, it is possible to obtain the respective extrusion lengths of the tilt parts 25, 26 by integration of an extrusion length $\Delta L$ for every elapsed time $\Delta t$ according to a traveling amount of each of the tilt parts 25, 26. By so doing, necessary respective extrusion lengths can be obtained by controlling timing for stopping the traveling of the movable dies 38, 38. In FIG. 6, the extrusion length of the first tilt part 25 is indicated as Lb, and the extrusion length of the second tilt part 26 is indicated as Ld by way of example. While the extrusion rate of the hollow section 10 gradually increases at the time of extruding the first tilt part 25, the extrusion rate gradually decreases at the time of extruding the second tilt part 26.

As described in the foregoing, with the hollow section 10 according to the present embodiment, the tilt parts 25, 26, each varying in width along the direction of the extrusion, are integrally formed with the parallel parts 21, 22, each keeping constant in width, by extrusion forming. Accordingly, in contrast to the case where a separate member is combined with the hollow section 10 by welding fitting, and so forth, it is possible to decrease the number of man-hours for production, and variation in size, as well. Furthermore, since the hollow section 10 is formed by extrusion forming, it is possible to form one in a shape gradually varying in width along the direction of the extrusion without executing a secondary work such as cutting and so forth. In addition, the tilt parts 25, 26 each are of a shape varying in width only in one direction within a section vertical to the direction of the extrusion, along the direction of the extrusion, so that even in the case of forming the hollow section 10 by extrusion forming, it is possible to restrain the forming apparatus 30 from becoming complex.

Further, since the hollow section 10 according to the present embodiment is formed so as to be symmetrical with respect to the plane 28, the hollow section 10 exhibits the same characteristics regardless of from whichever side of the plane 28 a load is imposed thereon. Accordingly, the hollow section 10 will be effective if used at a site where a direction in which a load is imposed cannot be established.

Further, with the forming apparatus 30 according to the present embodiment, it is possible to form the hollow section 10 varying in width along the direction of the extrusion by causing the movable dies 38, 38 to travel at the time of extrusion forming. Furthermore, with the forming apparatus 30, since the movable dies 38, 38 are made up so as to be able to travel in the direction tilt to the direction of the extrusion, it is possible to eliminate the need for applying a sealing force to the movable dies 38, 38 as in the case of a makeup for causing the movable dies 38, 38 to travel in the direction orthogonal to the direction of the extrusion. In consequence, it is possible to reduce wear and tear occurring to the slidably contact faces between the fixed die 36, and the respective movable dies 38, 38.

Still further, with the forming apparatus 30 according to the present embodiment, since a ratio of change in the width of the hollow section 10 can be changed by varying traveling speeds of the respective movable dies 38, 38, it is possible to enhance flexibility in designing the hollow section 10.

Figure 7:
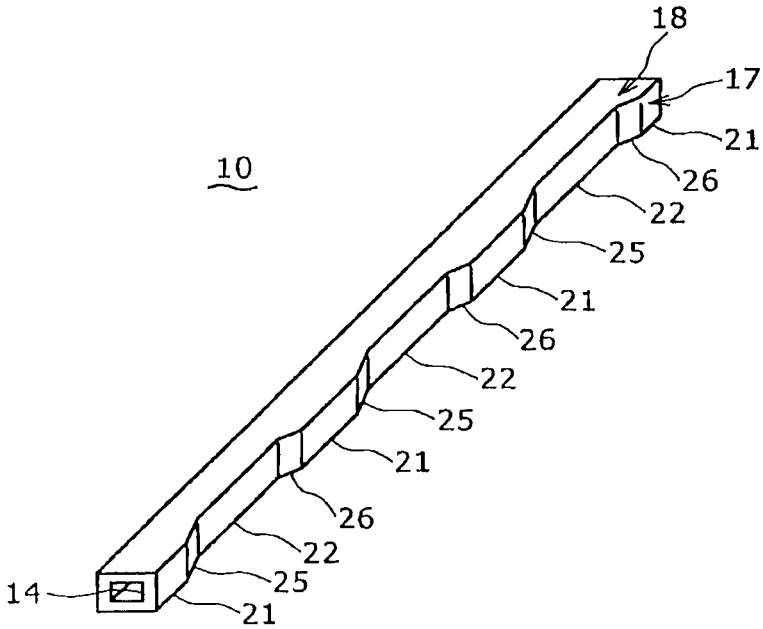
FIG. 7 is a view corresponding to FIG. 1, showing a hollow section according to another embodiment of the invention.
Figure 8:
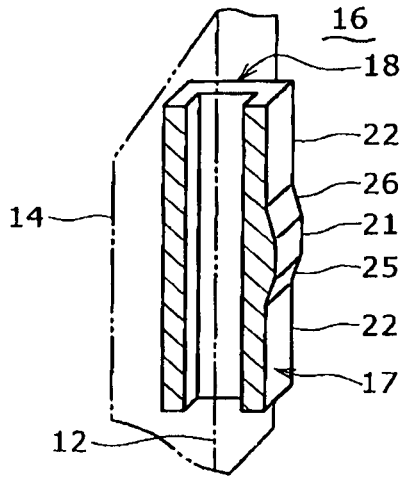
FIG. 8 is a view corresponding to FIG. 2, showing the hollow section in FIG. 7.

Now, it is to be pointed that the invention be not limited to the embodiment described in the foregoing, and that various changes and modification may be suitably made in the invention without departing from the spirit and scope of the subjoined claims. For example, the hollow section 10 can be formed in a shape asymmetrical with respect to the plane 28 containing the cylinder axis 12. As shown in, for example, FIGS. 7, and 8, one of the side faces 17, 17, opposing each other, in the crosswise direction, may be formed in the depressed shape, and the protruded shape, respectively, while the other may be formed planar in shape. With the hollow section 10 according to this embodiment of the invention, the tilt parts 25, 26 each have a width on one side of the plane 28, varying along the direction of the extrusion while a width thereof, on the other side of the plane 28, remains constant along the direction of the extrusion. Since this hollow section 10 is formed so as to be asymmetrical with respect to the plane 28, characteristics exhibited by the hollow section 10 will vary according to a direction in which a load is imposed. For this reason, with this hollow section 10, it is possible to adopt a design particularly robust against a load imposed from a given direction. Accordingly, this hollow section 10 will be effective if used at a site where the direction in which a load is imposed is established.

Figure 9:
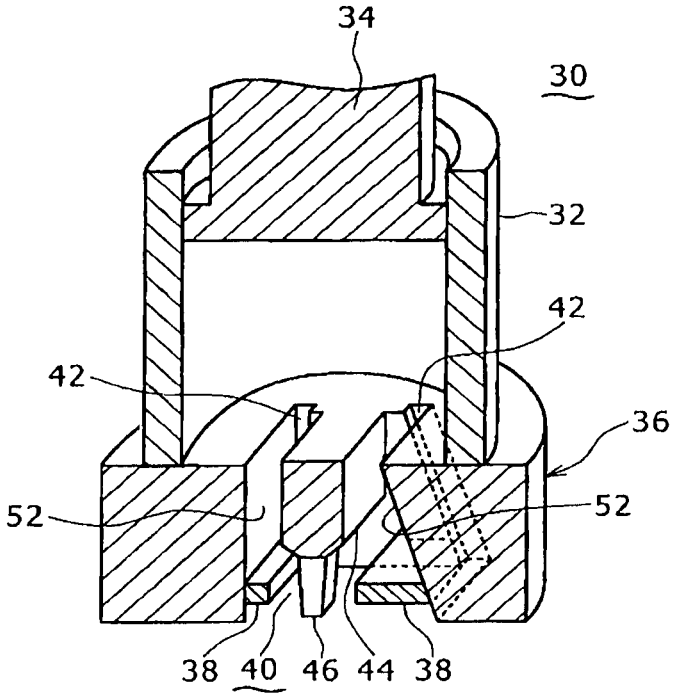
FIG. 9 is a view corresponding to FIG. 3, broadly showing principal parts of a forming apparatus for forming the hollow section shown in FIG. 7.
Figure 10:
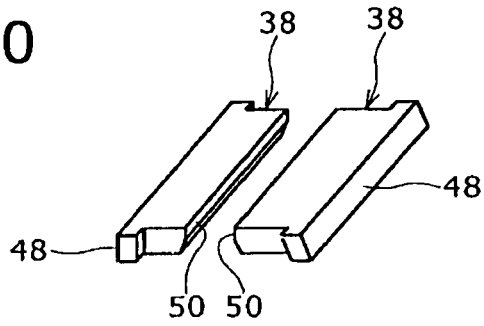
FIG. 10 is a perspective view of movable dies provided in the forming apparatus in FIG. 9.

In order to form the hollow section 10 according to this embodiment of the invention, use is made of a forming apparatus 30 shown in FIG. 9. With this forming apparatus 30, while one of two guide grooves 42, 42, provided in a forming hole 40 of a fixed die 36, is made up in the same manner as in the case of the preceding embodiment, the other guide groove 42 is formed so as to be parallel with the direction of extrusion. Further, as shown in FIG. 10, while one movable die 38, on one side of a pair of movable dies 38, 38, is formed in the same shape as in the case of the preceding embodiment, a slidably contact face 48, and a forming face 50 of the other movable die 38 (on the left-hand side in FIG. 10) are formed so as to be parallel with each other, and the slidably contact face 48, and the forming face 50 are parallel with the direction of the extrusion with the movable dies 38, 38, kept in a state as set in the guide grooves 42, 42, respectively. In this case, there may be adopted a structure in which a die having a length along the direction of the extrusion, identical to a length of a hole forming part 46, is used in place of the movable die 38 fitted into the guide groove 42, and parallel with the direction of the extrusion, and the die is prevented from traveling in the direction of the extrusion.

Figure 11:
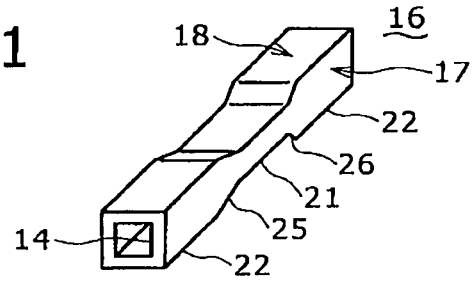
FIG. 11 is a perspective view of a partial section divided from a hollow section according to still another embodiment of the invention.
Figure 12:
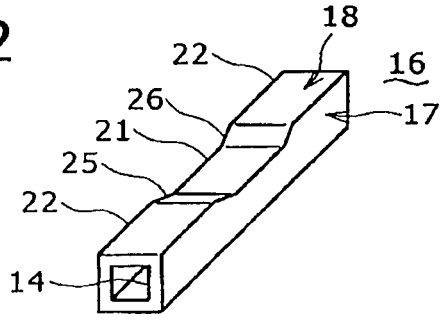
FIG. 12 is a perspective view of a partial section divided from a hollow section according to a further embodiment of the invention.
Figure 13:
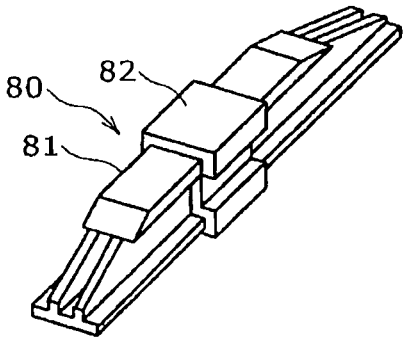
FIG. 13 is a perspective view of a conventional hollow section.

Further, as shown in FIGS. 11, and 12, a partial section 16 obtained by division my be formed such that a first parallel part 21 at the central part of the partial section 16 is in a shape smaller in width or height than second parallel parts 22, 22, disposed at respective ends of the partial section 16.

Now there is described hereinafter a summary of the present embodiment of the invention.

With the present embodiment, the tilt parts each having a width in one direction within a section vertical to the direction of the extrusion, varying along the direction of the extrusion, are integrally formed with the parallel parts each having a width kept constant, by extrusion forming, so that in contrast to the case where a separate member is combined with a hollow section by welding, fitting, and so forth, the number of man-hours for production can be decreased, and furthermore, variation in size as well can be decreased. Furthermore, since the hollow section is formed by extrusion forming, it is possible to form one in a shape gradually varying in width along the direction of the extrusion without executing a secondary work such as cutting and so forth. In addition, the tilt parts each are of a shape varying in width only in one direction within the section vertical to the direction of the extrusion, along direction of the extrusion, so that even in the case of forming the hollow section by extrusion forming, it is possible to restrain the forming apparatus from becoming complex.

With the extruded hollow section according to the present embodiment, the respective tilt parts and the respective parallel parts are alternately formed along the direction of the extrusion.

The tilt parts each are formed in a shape symmetrical with respect to the plane containing the axis extending in the direction of the extrusion.

With this embodiment, the extruded hollow section is formed in the shape symmetrical with respect to the plane, so that the same characteristics are exhibited regardless of from whichever side of the plane a load is imposed thereon. Accordingly, the extruded hollow section is effective if used at the site where the direction in which a load is imposed cannot be established.

The tilt parts each may be formed in a shape asymmetrical with respect to the plane containing the axis extending in the direction of the extrusion.

With such an embodiment, the extruded hollow section is formed in the shape asymmetrical with respect to the plane, so that the characteristics as exhibited varies according to the direction in which a load is applied, and it is therefore possible to adopt the design particularly robust against the load imposed from the given direction. Accordingly, this extruded hollow section is effective if used at the site where the direction in which the load is imposed is established.

The extruded hollow section is made of a light metal.

The present embodiment relates to a forming apparatus for forming the extruded hollow section, the forming apparatus comprising a fixed die provided with a forming hole having guide grooves extending in a direction tilting against a direction of extrusion, and movable dies disposed so as to be able to travel along the guide grooves, respectively, wherein the fixed die has a base part provided so as to bridge between inner faces of the forming hole, and a hole forming part extended from an end of the base part, on a downstream side thereof, toward downstream inside the forming hole while the movable dies are disposed inside the forming hole with a gap remaining between the hole forming part, and each of the movable dies.

With this forming apparatus, a hollow section turned tubular in shape is extruded through the gaps formed around the hole forming part, between the hole forming part, and the movable dies. Further, by causing the movable dies to travel at the time of extrusion forming, it is possible to form the hollow section varying in width in the one direction along the direction of the extrusion. Furthermore, with the forming apparatus, since the movable dies 38, 38 can travel in the direction tilting to the direction of the extrusion, there is no need for applying a sealing force to the movable dies in contrast to the case of the makeup for causing the movable dies 38, 38 to travel in the direction orthogonal to the direction of the extrusion. Accordingly, it is possible to reduce wear and tear occurring to the slidably contact faces between the fixed die, and the respective movable dies.

With this forming apparatus, the forming hole preferably has a pair of planes opposing each other, and parallel with the direction of the extrusion, and the respective guide grooves are preferably formed so as to extend in the direction tilting against the direction of the extrusion, over the planes opposing each other.

With this embodiment, regardless of whether or not the movable dies travel, parallel faces remaining constant in width in a direction orthogonal to the one direction can be formed by the planes opposing each other. And by causing the movable dies to travel, it is possible to form the tilt parts each varying in width in the one direction along the direction of the extrusion.

The present embodiment relates to a method for forming the extruded hollow section, using a forming apparatus including a fixed die provided with a forming hole having guide grooves extending in a direction tilting against a direction of extrusion, and movable dies disposed so as to be able to travel along the guide grooves, respectively, and the fixed die has a base part provided so as to bridge between inner faces of the forming hole, and a hole forming part extended from an end of the base part, on a downstream side thereof, toward downstream inside the forming hole. The method includes the steps of extruding the parallel parts with the movable dies as-stopped state, and extruding the tilt parts while causing the movable dies to travel along the guide grooves, respectively.

With this method for forming the extruded hollow section, a ratio of change in width along the direction of the extrusion may be changed by varying traveling speeds of the respective movable dies.

With the present embodiment, the hollow section with the tilt parts varying in a ratio of change in the width in the one direction can be formed by extrusion, so that it is possible to enhance flexibility in designing the hollow section.

As described hereinbefore, with the present embodiment, the hollow section can be fabricated in fewer production man-hours, and furthermore, the hollow section as fabricated can be one stable in quality.

The invention claimed is:

1. A forming apparatus for forming an extruded hollow section having parallel parts, wherein an external periphery of said extruded hollow section at said parallel parts has a width, in one direction vertical to a direction of extrusion, which is constant along the direction of extrusion throughout the length of the parallel parts in the direction of extrusion; and tilt parts, wherein the external periphery of said extruded hollow section at said tilt parts has a width, in the one direction, varying along the direction of the extrusion throughout the length of the tilt parts in the direction of extrusion, wherein the parallel parts are integrally formed with the tilt parts, and wherein internal peripheries of all of said parallel parts and internal peripheries of all of said tilt parts have the same widths as one another in said one direction throughout the length of said extruded hollow section in the direction of extrusion, whereby the width of the internal periphery of said extruded hollow section in said one direction is the same throughout the length of said extruded hollow section in the direction of extrusion, said forming apparatus comprising:

a fixed die provided with a forming hole having guide grooves extending in a direction tilting with respect to the direction of extrusion; and movable dies disposed so as to be able to travel along the guide grooves, respectively, wherein the fixed die has a base part provided so as to bridge between inner faces of the forming hole, and a hole forming part extended from an end of the base part, on a downstream side thereof, toward downstream inside the forming hole, wherein the movable dies are disposed inside the forming hole, with a gap remaining between the hole forming part and each of the movable dies, to establish a passage for the extrusion of the extruded hollow section.

2. The forming apparatus for forming the extruded hollow section, according to claim 1, wherein the forming hole has a pair of planes opposing each other, parallel with the direction of the extrusion, and the respective guide grooves extend in the direction tilting against the direction of the extrusion, over the planes opposing each other.

3. The forming apparatus according to claim 1, wherein the tilt parts each are formed in a shape asymmetrical with respect to a plane extending in said one direction and containing an axis extending in the direction of extrusion.

4. The forming apparatus according to claim 1, wherein said movable dies are shaped as plates having planar surfaces extending orthogonal to the direction of extrusion.

* * * * *